United States Patent [19]

Sato et al.

[11] Patent Number: 4,528,918

[45] Date of Patent: Jul. 16, 1985

[54] METHOD OF CONTROLLING COMBUSTION

[75] Inventors: Yoshio Sato, Hitachi; Nobuo Kurihara, Hitachiota; Hiroshi Matsumoto, Ibaraki; Tadayoshi Saito, Hitachiota; Mitsuyo Nishikawa; Toshihiko Higashi, both of Hitachi, all of Japan

[73] Assignee: Hitachi, Ltd., Tokyo, Japan

[21] Appl. No.: 601,613

[22] Filed: Apr. 18, 1984

[30] Foreign Application Priority Data

Apr. 20, 1983 [JP] Japan ..... 58-70609

[51] Int. Cl.[3] ..... F23D 1/00; F23N 5/02

[52] U.S. Cl. ..... 110/347; 431/10; 110/185; 110/343; 110/345

[58] Field of Search ..... 110/347, 343, 344, 345, 110/341, 185, 190; 431/10

[56] References Cited

U.S. PATENT DOCUMENTS

| | | | |
|---|---|---|---|
| 3,746,498 | 7/1973 | Stengel | 431/10 |
| 3,890,084 | 6/1975 | Voorheis et al. | 431/10 |
| 4,021,186 | 5/1977 | Tenner | 431/10 |
| 4,144,017 | 3/1979 | Bansin et al. | 431/10 |
| 4,289,474 | 9/1981 | Honda et al. | 431/10 |
| 4,335,084 | 6/1982 | Brogan | 110/345 |
| 4,403,941 | 9/1983 | Okima et al. | 110/347 |
| 4,422,391 | 12/1983 | Izuha et al. | 110/347 |
| 4,424,754 | 1/1984 | Coleman et al. | 110/347 |
| 4,427,362 | 1/1984 | Dykema | 110/345 |

*Primary Examiner*—Henry C. Yuen

*Attorney, Agent, or Firm*—Antonelli, Terry & Wands

[57] ABSTRACT

A method of controlling combustion in a furnace of a boiler or the like having a burner for a main combustion and a burner for a reducing combustion in order to effect combustion for furnace denitrification. The method comprises the steps of: estimating the $NO_x$ generation amount from data on a flame formed by the main combustion; estimating the reducing agent generation amount from data on a flame formed by the reducing combustion; and controlling the flow rates of fuel and air supplied for the main and reducing combustions so that the amount of $NO_x$ emission as the difference between the $NO_x$ generation amount and the reducing agent generation amount is below a specified value. In practice, each of the $NO_x$ generation amount and the reducing agent generation amount is estimated from the flame pattern, the flame volume, the distance between the outlet of the burner concerned and the root of the flame concerned, etc., thereby to distributively control the flow rates of fuel and air supplied to each of the main combustion burner and the reducing combustion burner so that the amount of $NO_x$ emission is below a specified value.

15 Claims, 14 Drawing Figures

METHOD OF CONTROLLING COMBUSTION

BACKGROUND OF THE INVENTION

The present invention relates to a method of controlling combustion in a furnace of a boiler or the like, and more particularly, to a method of controlling combustion in a furnace of a plant required to reduce the amount of nitrogen oxides ($NO_x$) generated therein.

The formation of nitrogen oxides ($NO_x$) is one of serious problems which must be taken into consideration particularly in combustion in a boiler employed in a thermal power plant or the like. The combustion conditions are increasingly stringent partly because regulatory standards are set for limiting the extent of $NO_x$ production from boilers. Accordingly, various techniques are being developed to control the formation of $NO_x$ by modifying the combustion method. Particularly, when pulverized coal is burned, there are large variations in amount of generation of $NO_x$ depending on the type of coal as compared with the combustion of other fuels; hence, it is important to develop a method of controlling combustion which makes it possible to limit the amount of $NO_x$ emission. However, it is conventionally difficult to control the $NO_x$ emission, since the formation of $NO_x$ is a very complex phenomena involving aerodynamics, physical, chemical and thermal considerations.

One proposal of the prior art to control the $NO_x$ emission is an improvement in the structure of a furnace, e.g., U.S. Pat. No. 4,294,178 "Tangential Firing System" (Oct. 13, '81). Described therein is a steam generator which is arranged such that the pulverized coal and primary air introduced from each of the four corners of a furnace are directed tangentially to an imaginary circle in the center of the furnace so as to minimize both the formation of waterwall slagging and corrosion and also the formation of nitrogen oxides, and which includes means for introducing the secondary air so that the air is directed tangentially to a second imaginary circle.

Further, as prior art concerning the burner structure, there is U.S. Pat. No. 4,173,118 directed to "Fuel Combustion Apparatus Employing Staged Combustion" (Nov. 6, '79). Described therein is an apparatus having a combustor with a double concentric combustion cylinder for effecting combustion in each of the rich mixture, lean mixture and dilution zones.

However, there is no prior art known concerning a technique to effect an on-line control of the amount of $NO_x$ produced in a furnace. One of the reasons for this is that there is no known technique to properly know and understand the state of $NO_x$ during combustion. In other words, even in a plant provided with a burner for reducing $NO_x$, the state of formation of $NO_x$ during combustion is not properly understood; hence, there are no information and instruction available for controlling the amounts of fuel and air supplied. As the prior art having improved the response to changes in load demand of boilers, there is U.S. Pat. No. 4,332,207 "Method of Improving Load Response on Coal-Fired Boilers" (June 1, '82). However, there is no prior art about a technique to effect on-line control of the $NO_x$ emission in such a plant that there are changes in properties of fuel, e.g., the change in type of coal.

SUMMARY OF THE INVENTION

It is an object of the present invention to control the amount of $NO_x$ discharged to the outside of a furnace through on-line estimation of the amounts of $NO_x$ and a reducing agent generated in the furnace by making use of data on flames produced by the combustion.

It is another object of the present invention to control the amount of $NO_x$ discharged to the outside of the furnace so as to be below a predetermined value even when there are changes in properties of fuel supplied to the furnace.

Basically, the invention provides a method of controlling combustion in a furnace having at least a burner for a main combustion and a burner for a reducing combustion, comprising the steps of: measuring data on flames, such as the flame pattern in each combustion; estimating the amount of generation of $NO_x$ and a reducing agent from the measured flame data; and controlling the flow rate of fuel supplied to each of the main combustion burner and the reducing combustion burner so that the amount of $NO_x$ emission is below a predetermined value.

According to a preferred form of the invention, there is provided a method of controlling combustion in the above-mentioned furnace, wherein a region of a main combustion flame or a reducing combustion flame having a luminance exceeding a predetermined value is defined as a flame pattern to estimate the volume of the flame with this pattern, and the amount of generation of $NO_x$ or reducing agent is estimated as a value proportional to the estimated flame volume.

According to another preferred form of the invention, there is provided a method of controlling combustion in the above-mentioned furnace, wherein the flame volume is estimated from the projected area of the main combustion flame or reducing combustion flame.

According to still another preferred form of the invention, there is provided a method of controlling combustion in the above-mentioned furnace, wherein the amount of a reducing agent generated by the reducing combustion from the amount of $NO_x$ generated by the main combustion.

According to a further preferred form of the invention, there is provided a method of controlling combustion in the above-mentioned furnace, wherein a pulverized coal mill model is prepared for the estimation of the flow rate of pulverized coal including many noise components, and the flow rate is estimated by the use of the Kalman filter.

According to a still further preferred form of the invention, there is provided a method of controlling combustion in the above-mentioned furnace, comprising the steps of: estimating a target value of the volume of a flame formed by the reducing combustion burner, together with a target value of the volume of a flame formed by the main combustion burner, corresponding to the target value of the volume of the flame formed by the reducing combustion burner, on the basis of the main combustion gas temperature, the reducing combustion gas temperature, the fuel properties, the total fuel demand quantity and a limiting value of the amount of $NO_x$ emission; and controlling the flow rate of fuel or air supplied for each of the combustions so that the flame volume obtained from the projected area of each of the flames is coincident with the corresponding target value.

The above and other objects, features and advantages of the invention will become clear from the following description of the preferred embodiments thereof taken in conjunction with the accompanying drawings.

EXPLANATION OF PRINCIPAL REFERENCE SYMBOLS $H_L$: coal calorific value
$\eta_B$: boiler efficiency
FRD: total fuel demand signal
BID: boiler input demand signal
$T_g$: combustion gas temperature
$C_{pg}$: gas specific heat
$F_f$: coal flow rate
$F_{gNOx}$: $NO_x$ generation amount in the main combustion zone
$F_{qNOx}$: $NO_x$ generation amount in the reducing combustion zone
$S_M$: area of the main combustion zone
$V_M$: volume of the main combustion zone
$F_{cb}$: flow rate of pulverized coal supplied to a burner
$\lambda$: air-fuel ratio
$T_M$, $T_R$: combustion gas temperatures in the main combustion zone and the reducing combustion zone, respectively
$d_M$, $d_R$: distances between the main combustion burner outlet and the root of the combustion flame formed thereby and between the reducing combustion burner outlet and the root of the combustion flame formed thereby, respectively
$V_M$, $V_R$: estimated volumes of the main combustion flame and the reducing combustion flame, respectively
$f_{fM}$,$F_{fR}$: flow rates of fuel supplied for the main combustion and the reducing combustion, respectively
$F_{NOxD}$: specified value of the amount of $NO_x$ emission
$F_{fMD,fRD}$: fuel flow rate demands for the main combustion and the reducing combustion, respectively.

DETAILED DESCRIPTION OF THE PREFERRED EMBODIMENT

Figure 1:
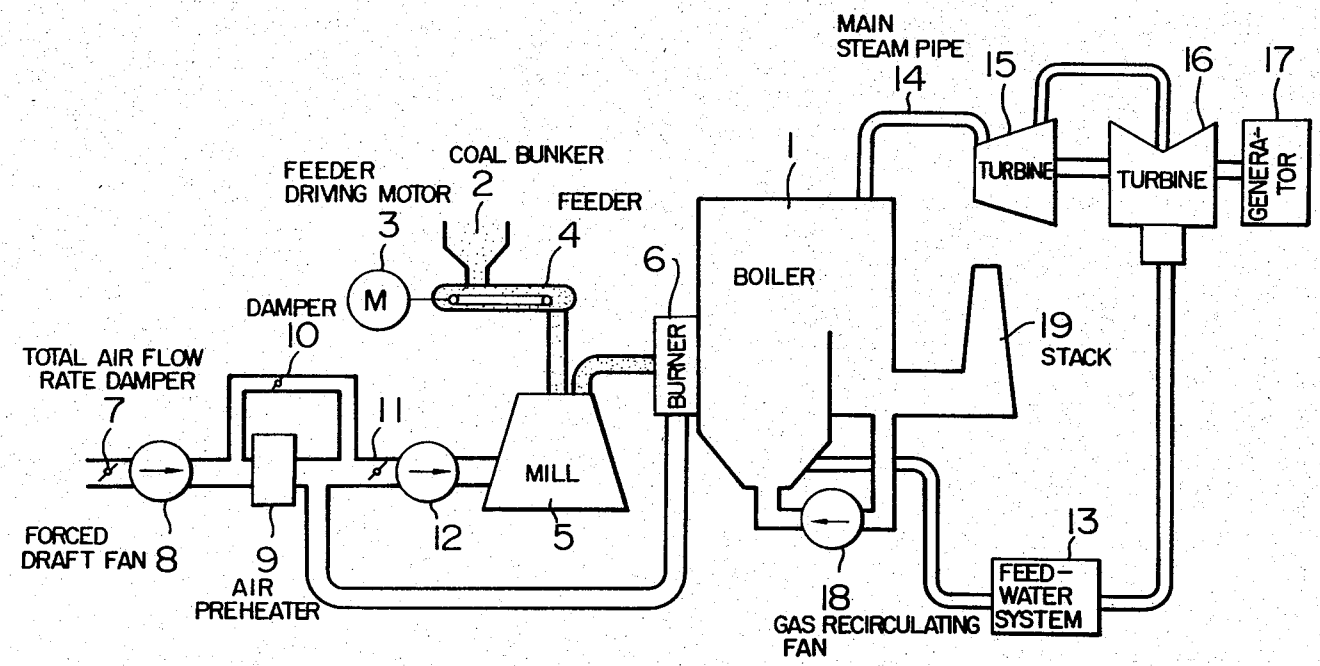
FIG. 1 is a schematic illustration of a coal-fired thermal power plant as one of objects to which the invention is applied.

Referring first to FIG. 1, which is a schematic illustration of a coal-fired thermal power plant as one of objects to which the present invention is applied, the coal to be burned in a boiler 1 is stored in a coal bunker 2 and is fed to a mill 5 by means of a feeder 4 driven by a motor 3. The coal is pulverized in the mill 5 and then supplied to a burner 6. The air for combustion is supplied to an air preheater 9 by means of a forced draft fan 8. One part of the air is supplied to the mill 5 through a primary air fan 12 so as to serve for carrying the pulverized coal, while the other part of the air is directly introduced to the burner 6 as air for combustion. Further, the air preheater 9 is provided with a by-pass system including a damper 10 such that the temperature of the primary air is controlled by the damper 10. In addition, the total amount of air required for combustion is controlled by a damper 7, while the amount of air required for carrying the pulverized coal is controlled by a damper 11. On the other hand, the feedwater pressurized in a feedwater system 13 becomes a superheated steam in the boiler 1 and is supplied to turbines 15, 16 through a main steam pipe 14. The turbines 15, 16 are rotated by the adiabatic expansion of the superheated steam to actuate a generator 17 to produce electric power. On the other hand, the exhaust gas of the fuel burned in the boiler 1 to heat the water and steam is sent to a stack 19 to be discharged into the atmosphere. A part of the exhaust gas is, however, returned to the boiler 1 by means of a gas recirculating fan 18.

Figure 2:
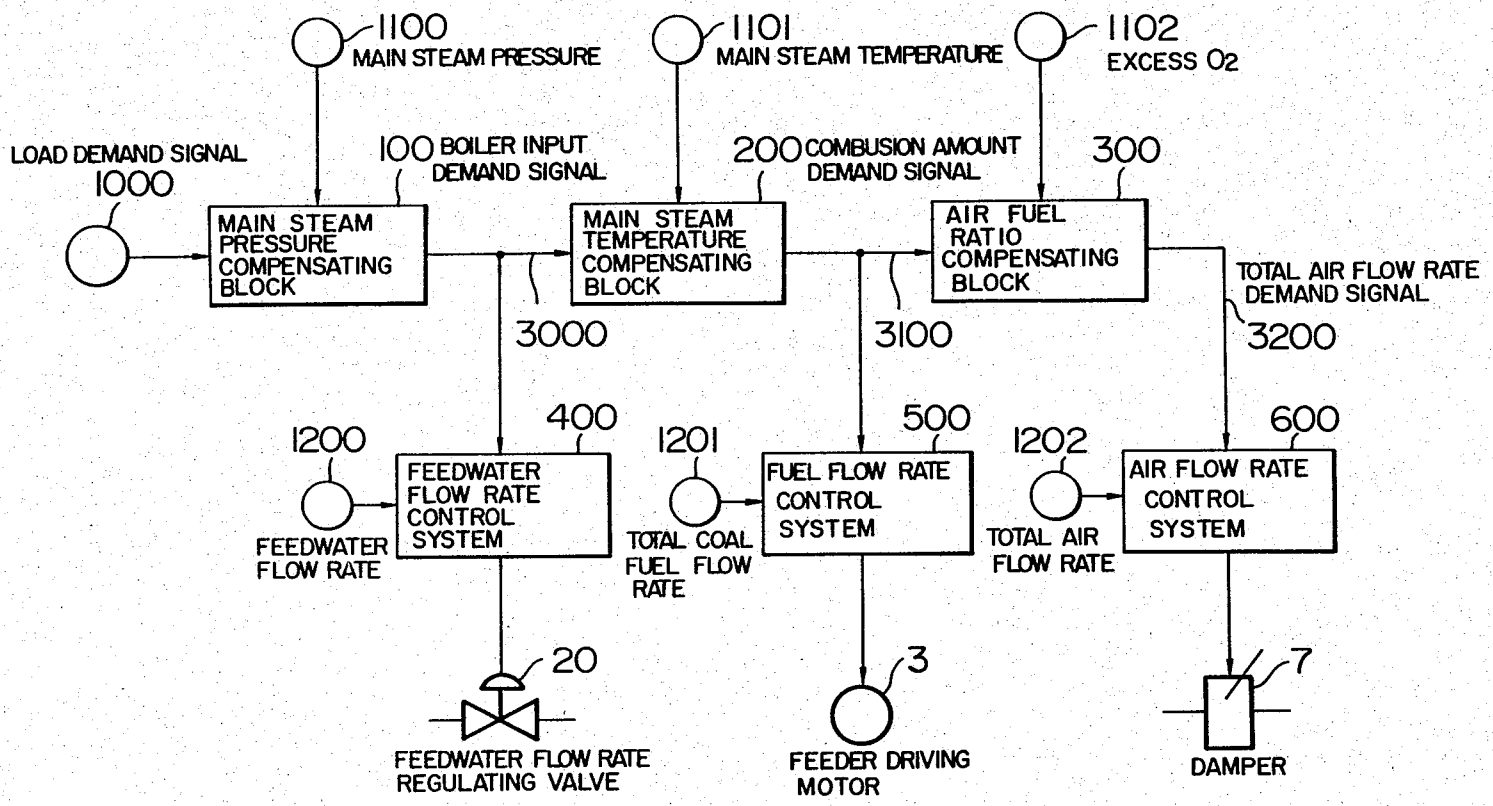
FIG. 2 PRIOR ART
FIG. 2 shows an example of a conventional control system.

To allow the above-described coal-fired thermal power plant to be smoothly run in response to a load demand command, it is necessary to properly control each valve, damper and motor. FIG. 2 is a schematic illustration of a typical conventional automatic control system for a thermal power plant. The functions of the automatic control system will be briefly described hereinunder with reference to the Figure.

First of all, a load (the output of the generator 17) demand signal 1000 applied to the thermal power plant is compensated in a main steam pressure compensation block 100) so that a main steam pressure 1100 is coincident with a predetermined value (a constant value in a constant-pressure power plant; a value in accordance with the load in a variable-pressure power plant), to become a boiler input demand signal 3000 applied to the boiler 1. The boiler input demand signal 3000 is introduced into a feedwater flow rate control system 400 as a value for setting a feedwater flow rate 1200 and is employed for controlling a feedwater flow rate regulating valve 20 as well as for determining a combustion amount demand signal 3100. The boiler input demand signal 3000 introduced into a main steam temperature compensation block 200 is compensated so that a main steam temperature 1101 is coincident with a predetermined value, thereby to determine the combustion amount demand signal 3100. The combustion amount demand signal 3100 is introduced into a fuel flow rate control system 500 as a value for setting a total coal fuel flow rate 1201 and is employed for controlling the motor 3 for driving the feeder 4. Further, the combustion amount demand signal 3100 is compensated in an air-fuel ratio compensation block 300 so that the excess $O_2$ 1102 in the exhaust gas is coincident with a predetermined value, to become a total air flow rate demand signal 3200. An air flow rate control system 600 control the damper 7 so that the total air flow rate 1202 is coincident with the value represented by the total air flow rate demand signal 3200.

In this control system, however, a change in the properties of the fuel will make it impossible to maintain the $NO_x$ value at a specified value, disadvantageously. Particularly, when coal is employed as fuel, there is a large change in properties thereof depending on the type of coal, and there are large variations even in the same type of coal, inconveniently. Even in the case of combustion of a COM (coal-oil mixture), a similar problem is encountered.

The present invention has been accomplished to solve the above-mentioned problem. According to the invention, the $NO_x$ generation amount and the reducing agent generation amount are estimated in an on-line manner from data on flames in a furnace, thereby to control combustion so that the value of $NO_x$ emission is below a specified value even when there is a change in the properties of a fuel.

In the case of the coal-fired thermal power plant, it is said that about 70% of the $NO_x$ generation is attributable to the N content contained in the fuel. In consequence, with boilers of the same capacity, $NO_x$ produced in the coal-fired thermal power plant is two to three times as much as that in the oil-fired thermal power plant. Therefore, in order to lower the $NO_x$ generation amount in the coal-fired thermal power plant to that in the conventional oil-fired thermal power plant or less, it is necessary to effect such a combustion control that the $NO_x$ generated through combustion is reduced within the furnace.

Figure 3:
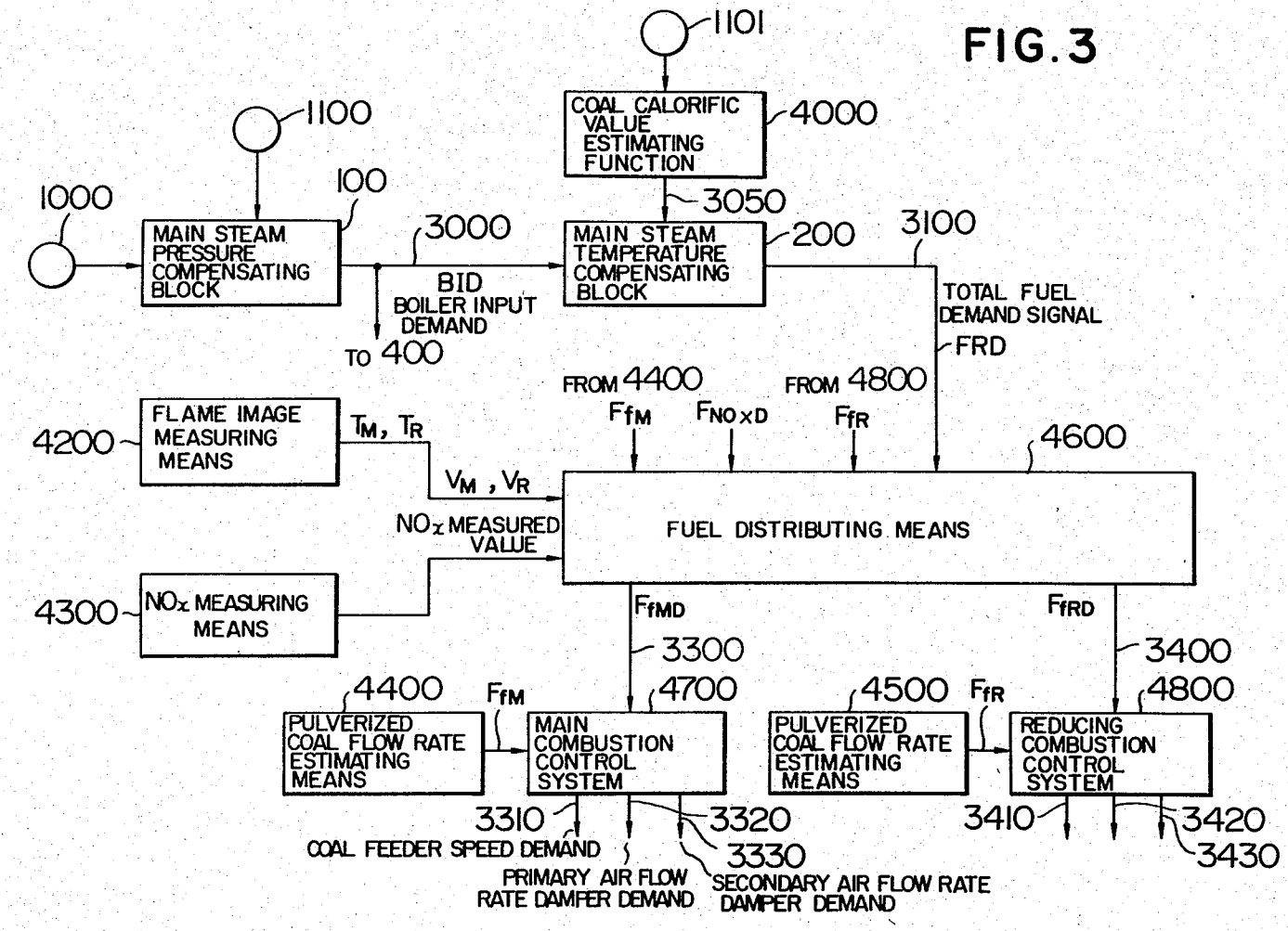
FIG. 3 is a schematic illustration of an embodiment of the invention, showing functions thereof.

FIG. 3 is a block diagram of the whole of a control system to which the invention is applied. In the Figure, only a fuel control system is shown, and the feedwater flow rate control system, and the total air flow rate control system in FIG. 2 are omitted. The control system shown in FIG. 3 has the following funtions added to that shown in FIG. 2;

(1) coal calorific value estimating function (4000)
(2) flame image measuring function (4200)
(3) $NO_x$ measuring function (4300)
(4) pulverized coal flow rate estimating functions (4400, 4500)
(5) fuel distribution determining function (4600)
(6) main combustion zone controlling function (4700)
(7) reducing combustion zone controlling function (4800)

Although the details of each of the functions will be described later, the features of the control system shown in FIG. 3 will be summed up as follows:

First, an optimum air-fuel ratio control in the furnace is realized by real-time measurement (estimation) of the properties of the coal before combustion and the pulverized coal flow rate at the burner inlet.

Second during combustion, with a combustion system, including a main combustion (producing $NO_x$) and a reducing combustion (reducing $NO_x$), taken as an object to be controlled, a main combustion fuel flow rate demand 3300 and a reducing combustion fuel flow rate demand 3400 are separately determined on the basis of the flame patterns, the result of measurement of the amount of $NO_x$ in the combustion gas.

Third, coal feeder speed demand signals 3310, 3410, primary air flow rate demand signals 3320, 3420 and secondary air flow rate demand signals 3330, 3430 are determined in consideration of dynamic properties of a pulverized coal mill.

Figure 4:
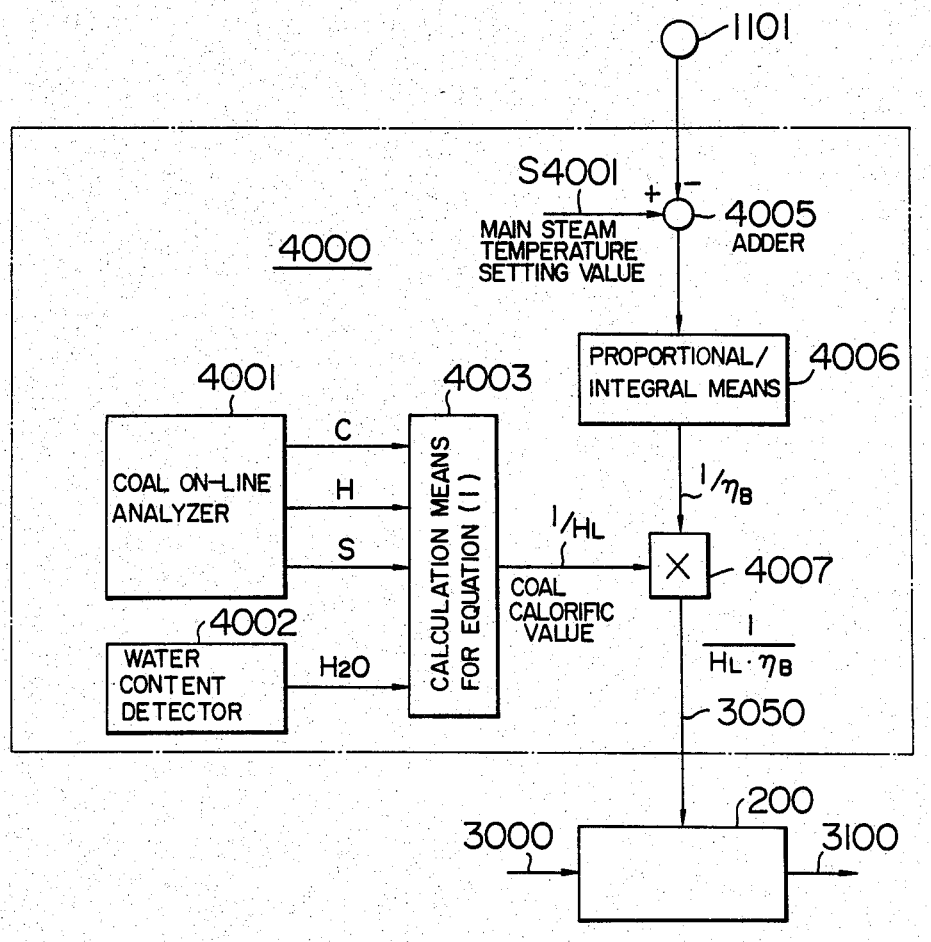
FIG. 4 is an illustration for describing the determination of a total fuel demand, showing an example of the measurement of the coal calorific value.

Each of the functions will be described hereinunder in detail. First of all, the coal calorific value estimating function will be explained. Examples of the coal real-time measuring method include "Coal process control with on-line nucoalyzer" (Coal Technology Europe '81, vol. 2, June 9–11, 1981). This method makes use of the principle that when neutrons are arranged to irradiate the flow of coal, the coal generates $\gamma$ rays characteristic of components contained therein. If an apparatus employing such a measuring method is used, it is possible to know the composition of coal: H, S, C, H, Cl, Si, Al, Fe, Ca, Ti, K and Na. In this measuring method, however, measurement is effected with respect to each element; therefore, the water content in coal must be compensated. An example of the method of estimating the coal calorific value will be explained with reference to FIG. 4. First of all, weight ratios of the coal components (carbon C, hydrogen H and sulfur S) are measured by means of a coal on-line analyzer 4001 and denoted by C, H, S, respectively. On the other hand, a weight ratio of the water content is detected by means of a water content detector 4002 and denoted by $H_2O$. Then, a coal calorific value $H_L$ (kcal/kg) is obtained in a calculating means 4003 by performing calculation through the following equation:

$$H_L 8100C + 28600(H - 1/9H_2O) + 2500S \quad (1)$$

On the other hand, a total fuel demand signal (FRD) 3100 represents the amount of input energy required for the boiler; therefore, the relationship between the total fuel demand signal (FRD) 3100 and a boiler input demand signal (BID) 3000 is expressed by the following equation (2):

$$FRD = BID/H_L \cdot \eta_B \quad (2)$$

The symbol $\eta_B$ in the equation represents the boiler efficiency, which changes with time. Therefore, the boiler efficiency must be compensated in a real-time manner. An example of the boiler efficiency compensating function is constituted by an adder 4005 and a proportional/integral means 4006 in FIG. 4. More specifically, in view of the fact that any change in boiler efficiency is shown by a deviation of a main steam temperature 1101 from a set value S4001, the difference therebetween is obtained by the adder 4005, and $1/\eta_B$ can be obtained through proportional/integral calculation by the means 4006. Accordingly, a compensating signal 3050 for componenting the total fuel demand signal (FRD) 3100 is obtained as the result of multiplication of $1/H_L$ and $1/\eta_B$ performed by a multiplier 4007. If the arrangement is such that the rated value of the boiler efficiency is represented by $1/\eta_{Br}$ and variations $\Delta 1/H_L$, $\Delta 1/\eta_B$ thereof are obtained, when it is possible to replace the multiplier 4007 with an adder.

Figure 5:
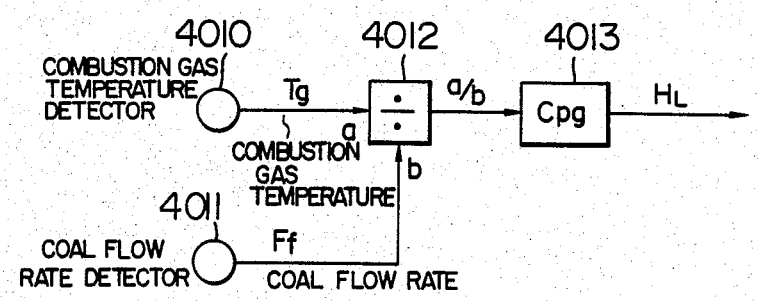
FIG. 5 shows another example of the measurement of the coal calorific value.

FIG. 5 shows the arrangement of another example of the method of estimating the coal calorific value $H_L$. In this case, the coal calorific value $H_L$ is estimated in view of the fact that a combustion gas temperature $T_g$ obtained from a detector 4010 is expressed by a gas specific heat $C_{pg}$, a coal feeder flow rate and a coal flow rate $F_f$ obtained from a mill differential pressure detector 4011 as follows:

$$T_g = C_{pg} H_L \cdot F_f \tag{3}$$

In FIG. 5, a reference numeral 4012 denotes a division means, while a numeral 4013 represents a coefficient means. As a matter of course, the boiler efficiency $\eta_B$ must be taken into consideration until the gas temperature $T_g$ has been converted into a main steam temperature; hence, it is necessary to effect compensation of $1/H_L \cdot \eta_B$ similarly to the coal calorific value estimating method shown in FIG. 4.

The following is the description of the flame image measuring function (4200).

In the furnace of a large-sized boiler for burning coal, burner groups arranged in three stages and three lines, for example, are disposed in front of the furnace, or the burner groups are disposed in front and at the rear of the furnace. The light from burner flames is collected by a condenser unit disposed at the root of each burner, for example, to obtain a flame signal, which is guided to an image pickup camera of an ITV through an image guide. Since a necessary part of this guide is received inside the furnace, the part, together with the condenser unit, must endure a high temperature inside the furnace; hence, a proper cooling is required.

Figure 6:
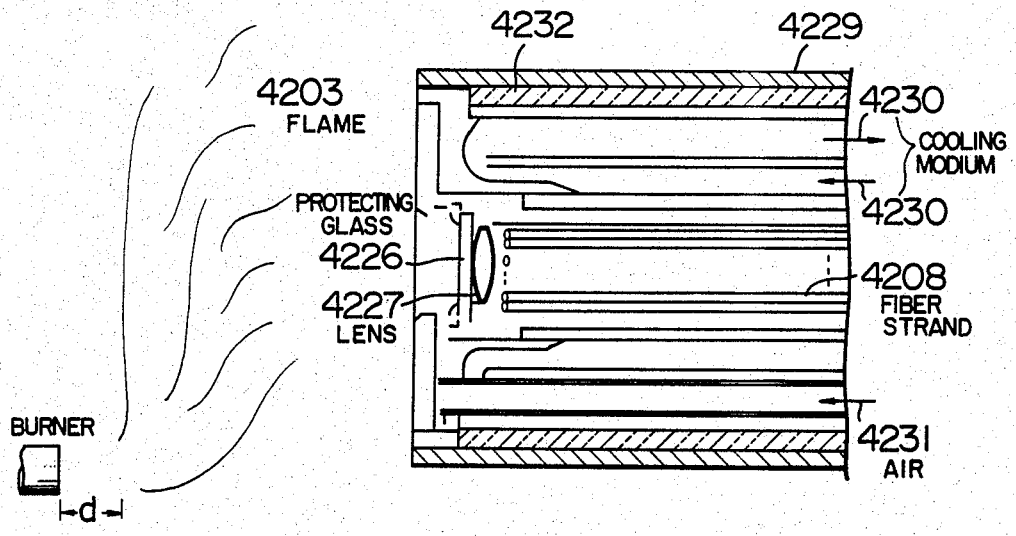
FIG. 6 shows an example of an image guide employed when the flame pattern is measured by means of an ITV.

FIG. 6 shows a practical example of the image guide for delivering the data on combustion flames 4203 to the image pickup camera.

The purpose of employing the image guide is such as follows. The flames can be observed in detail if it is possible to bring the image pickup camera itself closer to the flames. However, since the temperature inside the furnace of the boiler is above 1500° C., it is impossible to place the camera closer to the flames. For this reason, a lens 4227 is inserted into the furnace to form an image of flames, and the combustion flame image data (optical signal) is guided to the image pickup camera installed outside the furnace through an optical fiber. In FIG. 6, the image guide is constituted by 3000 to 30000 optical fiber strands 4208 each having a diameter of about 2 mm. The image guide is provided on the periphery of the bundle of the optical fiber strands with a passage for a cooling medium (water, air or the like) 4230, a heat-insulating material 4232 and a sheath 4229. The image guide has a diameter of about 50 mm. It is to be noted that a reference numeral 4226 denotes a protecting glass. Further, it is effective to maintain (purge) the front surface of the lens clean by means of air 4231 or the like in order to prevent the soot produced inside the furnace during combustion from attaching the lens system.

The following is the description of the method of estimating the volume of the combustion zone from the flame image data obtained by the ITV employing the abovedescribed image guide.

$NO_x$ generation amount $F_{gNox}$ in a main combustion zone and $NO_x$ reduction amount $F_{rNOx}$ in a reducing combustion zone may be expressed approximately by the following formulae (4) and (5):

$$F_{gNOx} \propto V_M \exp\left(\frac{-AM}{TM}\right) [P_N] \tag{4}$$

$$F_{rNOx} \propto V_R \exp\left(\frac{-AR}{TR}\right) [P_{NOx}] \tag{5}$$

Where,

T: temperature of combustion gas

V: volume of combustion zone

P: partial pressure

A: constant

Further, in the above formulae (4) and (5), suffixes M, R, N and $NO_x$ indicate main combustion, reducing combustion, nitrogen and $NO_x$, respectively.

It is understood from the above formulae (4) and (5) that the volume of each combustion zone largely affects the $NO_x$ generation and $NO_x$ reduction.

The combustion zone is considered to be a region in the measured picture image having a luminance (or temperature) above a certain level.

Figure 7:
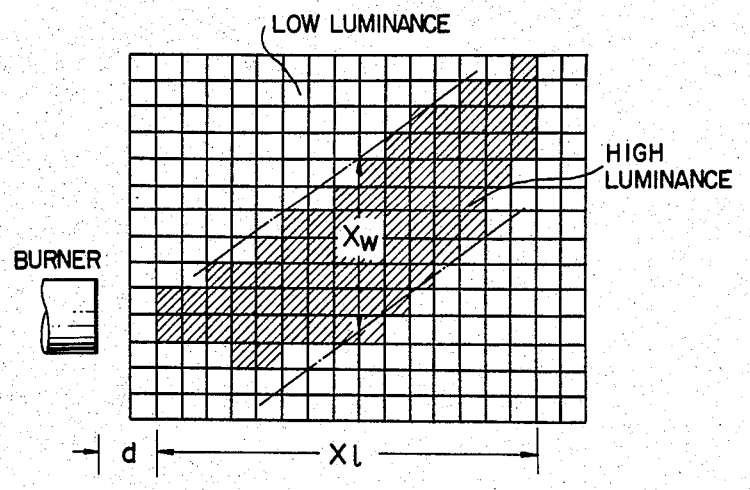
FIG. 7 is an illustration for describing an example of the way of taking a flame as an image.

One of examples of the method of estimating the volume of the combustion zone is such that an image, as a picked-up image of a flame, is meshed as shown in FIG. 7, for example, and a portion of the image having a luminance (or temperature) above a certain level, that is, the oblique-line portion in FIG. 7 is defined as a combustion zone, and then the area S of the combustion zone is obtained. The volume V of the combustion zone is a function of the area S. In the case of flames, there is a difference between a lengthwise stretching rate $k_l$ of a flame and a widthwise stretching rate $k_w$ thereof due to the variation in amount of the fuel. However, it may be possible to consider that $k_w = k \cdot k_l$. On the other hand, the area S and the volume V can be expressed by the length $x_l$ and width $x_w$ of the flame as follows:

$$S = x_w \cdot x_l \tag{6}$$

$$V = x_w \cdot x_l \tag{7}$$

where, $x_w$: flame means width $x_l$: flame length

Representing the area and volume of a new flame formed when the fuel has varied in quantity from the above circumstances by S′ and V′, respectively, the following equations are obtained:

$$\begin{aligned} S'/S &= x_w \cdot k_w \cdot x_l k_l / (x_w \cdot x_l) \\ &= k_w k_l \\ &\simeq k(k_l)^2 \end{aligned} \tag{8}$$

$$\begin{aligned} V'/V &= x_w^2 k_w^2 \cdot x_l k_l / (x_w^2 x_l) \\ &= k_w^2 k_l \\ &= k^2 k_l^3 \end{aligned} \tag{9}$$

When these equations are rearranged by substituting the equation (8) into the equation (9), the following equation is obtained:

$$V'/V = k^{\frac{7}{2}} \cdot (S'/S)^{\frac{3}{2}} \tag{10}$$

Since k can be assumed to be constant, the volume of the flame is estimated to be proportional to the 3/2 power of the flame image area.

Further, such a method may be employed that the volume of the flame is estimated from the flame length $x_l$ as follows:

$$x_l'/x_l = k_l$$

$$x_w'/x_w = k_w = k \cdot k_l$$

Therefore, V'/V is expressed as follows:

$$V'/V = k^2(x_l'/x_l)^3 \quad (11)$$

or $$V'/V = \frac{1}{k}(x_w'/x_w)^3 \quad (12)$$

Thus, the volume of the flame is estimated to be proportional to the flame length or width cubed.

In addition, such a method as CT (computer tomography) may be employed.

Figure 8:
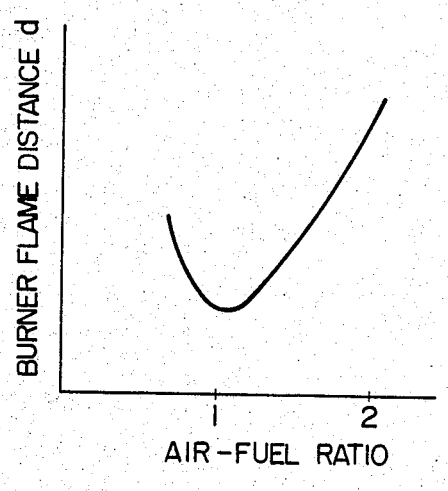
FIG. 8 shows the relationship between the air-fuel ratio and the distance between the burner outlet and the root of a flame formed thereby.
Figure 9:
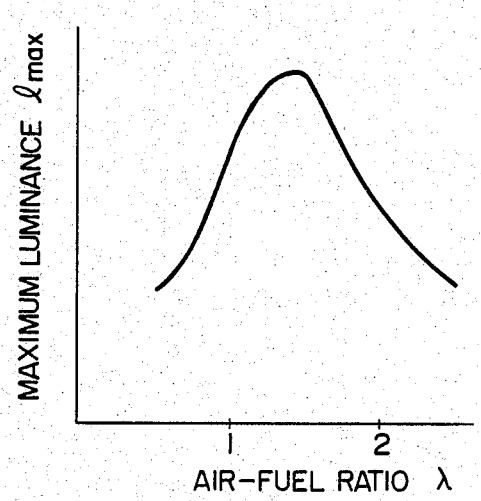
FIG. 9 shows the relationship between the air-fuel ratio and the maximum luminance of a flame.

In the above-described method wherein the volume of the combustion zone is obtained from the flame image, it is possible to further improve the accuracy in estimation of the $NO_x$ generation amount by making compensation with the distance d between the outlet of the burner and the root of the flame formed thereby and a maximum luminance $l_{max}$. In accordance with the ratio between the air quantity and the fuel quantity, that is, an air-fuel ratio λ, the distance between the burner outlet and the root of the flame varies as shown in FIG. 8, and the maximum luminance $l_{max}$ of the flame also varies as shown in FIG. 9. Accordingly, the maximum luminance $l_{max}$ is inversely proportional to the distance between the burner outlet and the root of the flame, and it is interpreted that in a region where the maximum luminance $l_{max}$ is large, the fuel is quickly burned at a position away from the burner. In consequence, even if the volume $V_M$ of the main combustion flame is small, the $NO_x$ generation amount $F_{gNOx}$ increases. From this reason, the equation (4) is assumed to be as follows:

$$F_{gNox} \propto V_M \cdot d_M \exp\left(\frac{-A_M}{T_M}\right) [P_N] \quad (13)$$

Therefore, in the main combustion zone, the above-mentioned V'/V is employed after being corrected into $(V_M'd')/(V_Md)$, thereby making it possible to improve the accuracy in estimation of the amount of generation of $NO_x$.

In "fuel split type burner" in which a flame is formed so that a main combustion zone and a reducing combustion zone are produced from a signal burner, the reducing combustion zone is wrapped by the main combustion zone; hence, there is a possibility that the reducing combustion zone cannot be obtained from the flame data shown in FIG. 7. In such a case, it is preferable to estimate the reducing combustion zone from the flame data in the main combustion zone and the ratio beteen the amounts of fuel burned in the combustion zones, respectively. In addition, the flame data on each combustion zone may be obtained through a filter in accordance with the wavelength of the light emitted from the flame in each combustion zone.

The following is the description of a method of actually measuring $NO_x$ employing a measuring apparatus 4300 utilizing the CARS light for calibraton in estimation of $NO_x$.

A CARS measuring apparatus including a laser oscillator and a spectrochemical analyzer is installed in the upper part of the furnace. The principle of the gas concentration measurement effected by this apparatus is, as known, such that an anti-Stokes' light, generated when a pump light and a Stokes' light are applied to the combustion gas from the laser oscillator, interferes with the former pump light to generate a new anti-Stokes' light, and a coherent CARS light generated as the result of such a chain reaction is utilized. The spectrum analysis of the CARS light makes it possible to obtain the $NO_x$ concentration as a gas concentration analysis value. The thus measured $NO_x$ concentration can be utilized for calibration of an $NO_x$ estimate in this embodiment.

In the case where the CARS measuring apparatus is employed for the above-mentioned fuel split type burner, it is preferable to effect measurement at the top end of the combustion flame.

The pulverized coal flow rate estimating functions 4400, 4500 will be described hereinunder.

It is desirable to measure the coal flow rate $F_f$ immediately before combustion, that is, at the burner inlet. Since there is no means for directly measuring the pulverized coal flow rate at the burner inlet, however, it is necessary to estimate the pulverized coal flow rate indirectly from the coal feeder flow rate and the mill differential pressure or the like.

Figure 10:
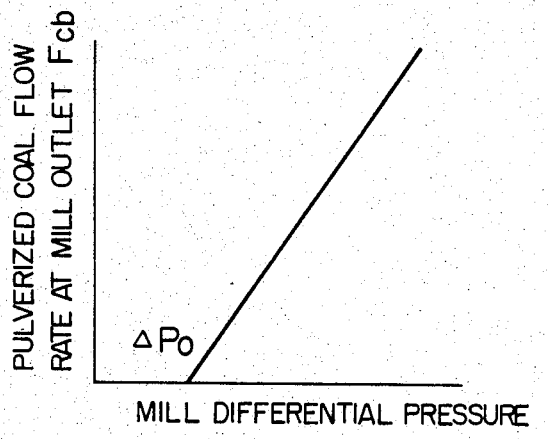
FIG. 10 shows the relationship between the mill differential pressure and the flow rate of pulverized coal at the mill outlet.

Examples of the conventional method of measuring the flow rate of coal flowing through the coal feeder include a volumetric method and a gravimetric method. In the volumetric method, the height of the coal layer on the coal feeder is maintained constant by means of a level bar, and the volumetric flow rate of the coal is measured from the speed of the coal feeder. In the gravimetric method, on the other hand, the weight of coal on the coal feeder is measured and multiplied by the speed of the coal feeder, thereby to measure the gravimetric flow rate of the coal. In consideration of the variations in density of the coal on the coal feeder, the gravimetric method is better in measuring accuracy and therefore is now mainly employed. In addition, there is another method in which the pulverized coal flow rate at the mill outlet is measured by utilizing the fact that the pulverized coal flow rate at the mill outlet is partially proportional to the mill differential pressure as shown in FIG. 10.

The above-described measuring methods all have both merits and demerits and any of them is incomplete. Therefore, there is a need for development of a technique to estimate the pulverized coal flow rate which minimizes the effects of dynamic characteristics of the mill and noises in observation.

The Kalman filtering is most suitable for the method of estimating the pulverized coal flow rate which minimizes the effects of dynamic characteristics of the process and noises in observation. When the equation of state pf an objective process and the observation equation are expressed by the following equations (14), (15), respectively:

$$X(i+1) = \Phi(i) \cdot X(i) + H(i) \cdot U(i) \quad (14)$$

$$Y(i) = C(i) \cdot X(i) + W(i) \quad (15)$$

where,

X(i): n-dimensional state vector at time i

U(i): m-dimensional control vector at time i

Y(i): r-dimensional observation vector at time i

W(i): r-dimensional observation noise vector

Φ, H, C: matrixes of n×n, n×m, and r×n, respectively then, the signal X(i) is expressed by the following equations (16) to (20) through the Kalman filtering:

$$\hat{X}(i)=\overline{X}(i)+P(i)C'W^{-1}\{Y(i)-(C(i)\overline{X}(i)+\overline{W(i)})\} \quad (16)$$

where, $$\overline{X}(i)=\Phi(i-1)\hat{X}(i-1)+H(i-1)\cdot U(i-1) \quad (17)$$

$$P(i)=\{M^{-1}(i)+C'(i)\cdot W^{-1}\cdot C(i)\}^{-1} \quad (18)$$

$$M(i)=\Phi(i-1)P(i-1)\Phi'(i-1)+H(i-1)U(i-1)H'(i-1) \quad (19)$$

initial conditions $$X(0)=X(0)$$

$$M(0)=X(0) \quad (20)$$

where, X, W, U: variances of X, W, U, respectively

Accordingly, the introduction of the state equation (14) with respect to the pulverized coal mill permits an estimation of the flow rate of pulverized coal employing the Kalman filtering.

The way of obtaining the state equation of the pulverized coal mill will be explained hereinunder.

Figure 11:
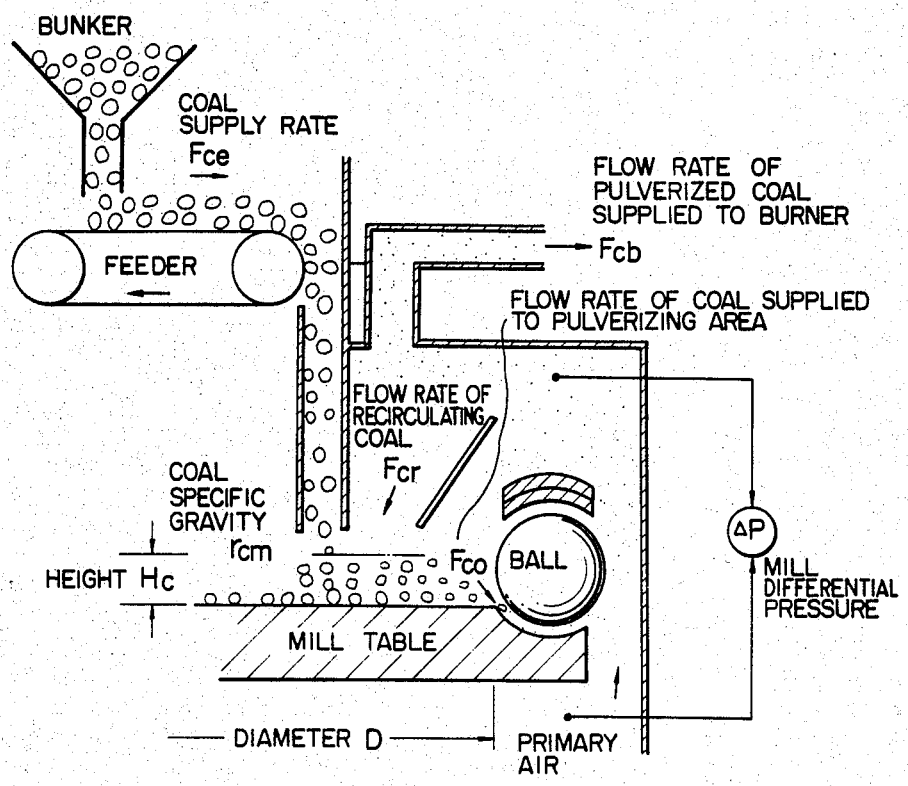
FIG. 11 is an illustration for describing the flow of coal through a mill.

Coal is pulverized through the process as shown in FIG. 11. More specifically, the coal supplied from the feeder is once accumulated on a mill table and is then supplied by the centrifugal force to the area between the mill table and a ball so as to be pulverized. The pulverized coal ground in the ball section is carried to a drum by means of a carrier air (generally referred to as "primary air"). However, the pulverized coal having a particle diameter less than 200 mesh is recirculated from the drum to the mill table section. The coal is gradually pulverized by the repetition of the above operation, and when becoming 200 mesh or more in particle diameter, the pulverized coal is carried into the burner. Accordingly, representing the mill table diameter and the mean specific gravity of the coal on the mill table by D and $\gamma_{cm}$, respectively, the height $H_c$ of the coal accumulated on the mill table is expressed by the following equation:

$$\frac{\pi D^2}{4}\gamma_{cm}\frac{dH_c}{dt}=F_{ce}+F_{cr}-F_{co} \quad (21)$$

where, $F_{ce}$: flow rate of coal supplied from the feeder $F_{cr}$: flow rate of coal recirculated from the drum $F_{co}$: flow rate of coal supplied to the pulverizing area between the mill table and the ball On the other hand, the flow rate of coal supplied to the area between the mill table and the ball is considered to be proportional to the centrifugal force applied to the coal accumulated on the mill table and therefore can be obtained through the following equation:

$$F_{co}=K_k\cdot T \quad (22)$$

where, $K_k$: rate of supply of coal to the pulverizing area between the mill table and the ball T: centrifugal force applied to the coal $$T=\frac{\pi}{3}\cdot D^3\cdot N_{MT}^2\cdot\gamma_{cm}\cdot H_c \quad (23)$$

where, $N_{MT}$: rotational speed of the mill table

Further, assuming that the pulverizing characteristic of the ball section can be approximated by the dead time characteristic and the flow rate of coal recirculated from the drum is proportional to the flow rate of coal entering the drum, the flow rate $F_{cr}$ of coal recirculated from the drum is expressed by the following equation:

$$F_{cr}=K_r e^{-LS}\cdot F_{co} \quad (24)$$

Accordingly, if the equations are rearranged by substituting the equations (22) to (24) into the equation (21), then the following equation is obtained:

$$\frac{\pi D^2}{4}\gamma_{cm}\frac{dH_c}{dt}=F_{ce}-K_c'H_c \quad (25)$$

where, $$K_c'=(1-K_r e^{-LS})\frac{\pi^2}{3}K_k D^3 N_{MT}^2\cdot\gamma_c$$

On the other hand, assuming that the coal within the drum is an object to be transported by the carrier air, the flow rate $F_{cb}$ of coal supplied to the burner is proportional to the volumetric flow rate of the carrier air. Accordingly, representing the gravimetric flow rate and specific gravity of the air by $F_a$ and $\gamma_a$, respectively, the following equation is established:

$$F_{cb}=\gamma_{cb}\cdot\frac{F_a}{\gamma_a} \quad (26)$$

However, according to the low of conservation of mass, the concentration $\gamma_{cb}$ of pulverized coal within the drum is expressed as follows:

$$V\frac{d\gamma_{cb}}{dt}=K_c'H_c-F_{cb} \quad (27)$$

where, V: drum internal volume Therefore, if the equations (26), (27) are rearranged, then the following equation is obtained:

$$\therefore V\frac{\gamma_a}{F_a}\cdot\frac{dF_{cb}}{dt}=K_c'H_c-F_{cb} \quad (28)$$

Therefore, if the equations (25), (28) are rearranged, then fundamental equations (29), (30) are obtained:

$$\frac{dF_{cb}}{dt}=-\frac{F_a}{V\gamma_a}F_{cb}+\frac{F_aK_c'}{V\gamma_a}H_c \quad (29)$$

$$\frac{dH_c}{dt}=-\frac{4K_c'}{\pi D^2\gamma_{cm}}H_c+\frac{4}{\pi D^2\gamma_{cm}}F_{ce} \quad (30)$$

Here, if $X=(F_{cb}, H_c)'$ as well as $U=(0, F_{ce})$, and the vector representation is effected, then the following equation is obtained:

$$\frac{dX}{dt} = AX + BU \tag{31}$$

where, $$A = \begin{pmatrix} A_{11} & A_{12} \\ A_{21} & A_{22} \end{pmatrix}, B = \begin{pmatrix} B_{11} \\ B_{22} \end{pmatrix}$$

$$A_{11} = -F_a/(V\gamma_a), A_{12} = F_a K_c'/(V\gamma_a)$$

$$A_{21} = 0, A_{22} = -4K_c'/(\pi D^2 \gamma_{cm})$$

$$B_{11} = 0, B_{22} = 4/(\pi D^2 \gamma_{cm})$$

If $\Phi(t, t_0) = L^{-1}\{SII - A\}^{-1}$ as well as $$H(t, t_0) = \int_{t_0}^{t} \Phi(t, \tau)B(\tau)d\tau$$

and these are rearranged into a discrete value form, then the following equation is obtained:

$$X(k) = \Phi(k-1) \cdot X(k-1) + H(k-1) \cdot U(k-1) \tag{32}$$

where, $$X(k) = X(k\Delta t)$$

$$\Phi(k-1) = \Phi(k\Delta t, (k-1)\Delta t)$$

Further, as mentioned beforehand, the flow rate $F_{cba}$ of pulverized coal supplied to the burner is partially proportional to the mill differential pressure $\Delta P$ as shown in FIG. 10, and the observation equation thereof can be expressed by the following equation:

$$F_{cba}(i) = Y_1(i) = C(\Delta P(i) - \Delta P_0) + W(i) \tag{33}$$

where, W(i): normal random numbers

If the thus introduced equations (32), (33) are substituted into the equations (14), (15), respectively, then it is possible to estimate the flow rate of pulverized coal at the burner inlet.

Next, the function 4600 for distributing fuel for the main combustion and the reducing combustion will be explained. First of all, the reaction mechanism in each of the main combustion zone and the reducing zone will be explained, although it has been described above.

Through the equations (4), (5), the $NO_x$ generation amount $F_{gNOx}$ in the main combustion zone and the $NO_x$ reduction amount $F_{rNOx}$ in the reducing combustion zone are expressed by the following equations, respectively:

$$F_{gNOx} = k_g V_M d_M \exp\left(\frac{-A_M}{T_M}\right) P_N \tag{34}$$

$$F_{rNOx} = k_r V_R d_R \exp\left(\frac{-A_R}{T_R}\right) P_{NOx} \tag{35}$$

where, $k_g$, $k_r$: reaction rate constants in generation and reduction of $NO_x$, respectively $V_M$, $V_R$: volumes of the main and reducing combustion zones (flames), respectively $A_M$, $A_R$: constants $T_M$, $T_R$: representative temperatures of the main and reducing combustion zones (flames), respectively $P_N$: nitrogen content ratio in fuel $P_{NOx}$: $NO_x$ partial pressure in the reducing combustion zone Since the $NO_x$ partial pressure in the reducing combustion zone is proportional to the $NO_x$ generation amount $F_{gNOx}$ in the main combustion zone, the equation (35) can be changed into the following equation (36):

$$F_{rNOx} = k_r V_R \exp\left(\frac{-A_R}{T_R}\right) d_M \cdot d_R\left\{k_p \cdot k_g V_M \exp\left(\frac{-A_M}{T_M}\right) P_N\right\} \tag{36}$$

where, $k_p$: a constant

Accordingly, the $NO_x$ emission amount $F_{NOx}$ is expresed as follows:

$$F_{NOx} = F_{gNOx} - F_{rNOx} = k_g V_M d_M \exp\left(\frac{-A_M}{T_M}\right) P_N\left\{1 - k_p k_r d_R V_R \exp\left(\frac{-A_R}{T_R}\right)\right\} \tag{37}$$

Since the total fuel demand FRD of the boiler is given by the function (200) the main combustion fuel flow rate $F_{fM}$ and the reducing combustion fuel flow rate $F_{fR}$ must satisfy the condition of the following equation (38):

$$F_{fM} + F_{fR} = FRD \tag{38}$$

Since the volumes $V_M$, $V_R$ of the main and reducing combustion zones are proportional to the fuel flow rates $F_{fM}$, $F_{fR}$, respectively, the following equations are established:

$$V_M = k_{VM} \cdot F_{fM} \tag{39}$$

$$V_R = k_{VR} \cdot F_{fR} \tag{40}$$

where, $k_{VM}$, $k_{VR}$: constants

If the equations (39), (40) are substituted into the equation (38), then the following equation is obtained:

$$\frac{V_M}{k_{VM}} + \frac{V_R}{k_{VR}} = F_{fD} \tag{41}$$

$$\therefore V_M = k_{VM}\left(F_{fD} - \frac{V_R}{k_{VR}}\right)$$

If the equation (41) is substituted into the equation (37), then the following equation is obtained:

$$F_{NOx} = k_g k_{VN}\left(F_{fD} - \frac{V_R}{k_{VR}}\right) \exp\left(\frac{-A_M}{T_M}\right) P_N \cdot \left\{1 - k_p k_r V_R \exp\left(\frac{-A_R}{T_R}\right)\right\} \tag{42}$$

Therefore, in order that $F_{NOx}$ obtained through the equation (42) is coincident with a specified value $F_{NOxD}$, the following condition must be satisfied:

$$k_g k_{VM}\left(F_{fD} - \frac{V_R}{k_{VR}}\right) \exp\left(\frac{-A_M}{T_M}\right) P_n \cdot \left\{1 - k_p k_r V_R \exp\left(\frac{-A_R}{T_R}\right)\right\} = F_{NOxD}$$

This is rearranged as follows:

$$k_g k_{VM}\exp\left(\frac{-A_M}{T_M}\right) P_N \frac{k_p k_r}{k_{VR}} \exp\left(\frac{-A_R}{T_R}\right) V_R^2 - k_g k_{VM}\exp\left(\frac{-A_M}{T_M}\right) P_N\left\{\frac{1}{k_{VR}} + k_p k_r \exp\left(\frac{-A_R}{T_R}\right) FRD\right\} V_R + k_g k_{VM}\exp\left(\frac{-A_M}{T_M}\right) P_N \cdot FRD - F_{NOxD} = 0$$

If this equation, which is a quadratic expression with respect to $V_R$, is solved, then it becomes the following equation:

$$V_R = \frac{-\left[k_g k_{VM}\exp\left(\frac{-A_M}{T_M}\right) P_N\left\{\frac{1}{k_{VR}} + k_p k_r \exp\left(\frac{-A_R}{T_R}\right) FRD\right\}\right] + \alpha}{2k_g k_{VM}\exp\left(\frac{-A_M}{T_M}\right) P_N\left(\frac{k_p k_r}{k_{VR}}\right) \exp\left(\frac{-A_R}{T_R}\right)} \quad (43)$$

$$\alpha^2 = \left[k_g k_{VM}\exp\left(\frac{-A_M}{T_M}\right) P_N\left\{\frac{1}{k_{VR}} + k_p k_r \exp\left(\frac{-A_R}{T_R}\right) FRD\right\}\right]^2 - 4k_g k_{VM}\exp\left(\frac{-A_M}{T_M}\right) P_N\left\{\frac{k_p k_r}{k_{VR}} \exp\left(\frac{-A_R}{T_R}\right)\right\} \cdot \left\{k_g k_{VM}\exp\left(\frac{-A_M}{T_M}\right) P_N \cdot FRD - F_{NOxD}\right\}$$

The equation (43) represents that if the combustion gas temperature $T_M$, $T_R$, the fuel properties $P_N$, the fuel demand FRD and the $NO_x$ eimission specified value $F_{NOxD}$ are given, the target value of $V_R$ is determined. In other words, representing $V_R$ determined by the equation (43) by $V_{RD}$, the target value $V_{MD}$ of $V_M$ is obtained through the equation (41) as follows:

$$V_{MD} = k_{VM}\left(F_{fD} - \frac{V_{RD}}{k_{VR}}\right) \quad (44)$$

Therefore, if the fuel and the other factors are controlled so that the flame volumes $V_M$, $V_R$ obtained by the flame measuring function (4200) are coincident with the thus obtained $V_{MD}$, $V_{RD}$, then it is possible to burn the demanded amount of fuel (FRD) while suppressing the $NO_x$ generation amount below the specified value $F_{NOxD}$.

Moreover, if $V_{MD}$, $V_{RD}$ are substituted into the equations (39), (40), then it is possible to determine the main combustion fuel demand $F_{fMD}$ (3300) and the reducing combustion fuel demand $F_{fRD}$ (3400) through the following equations, respectively:

$$F_{fMD} = V_{MD}/k_{VM} \quad (45)$$

$$F_{fRD} = V_{RD}/k_{VR} \quad (46)$$

By the way, $k_g P_N$ and $k_p k_r$ appearing in the equation (37) largely change according to the fuel properties and environmental conditions such as weather; therefore, it is desirable to successively estimate the changes thereof in an on-line manner and correct them with the estimated values. The compensation method will be explained hereinunder.

If two sets of actual measurements, that is, $NO_x$ obtained from an $NO_x$ measuring means 4300 and flame patterns $V_M$, $V_R$ and flame temperatures $T_M$, $T_R$ obtained from a flame image measuring means 4200, are represented by $NO_x(1)$, $V_M(1)$, $V_R(1)$, $T_M(1)$, $T_R(1)$ and $NO_x(2)$, $V_M(2)$, $V_R(2)$, $T_M(2)$, $T_R(2)$, respectively, then the following equations are obtained through the equation (37):

$$V_M(1)\exp\left(\frac{-A_M}{T_M(1)}\right) k_g P_N\left\{1 - V_R(1)\exp\left(\frac{-A_R}{T_R(1)}\right) k_p k_r\right\} = F_{NOx}(1) \quad (47)$$

$$V_M(2)\exp\left(\frac{-A_M}{T_M(2)}\right) k_g P_N\left\{1 - V_R(2)\exp\left(\frac{-A_R}{T_R(2)}\right) k_p k_r\right\} = F_{NOx}(2) \quad (48)$$

If the equation (47) is divided by the equation (48), then it is possible to obtain $k_p k_r$ as follows:

$$\frac{V_M(1)\exp\left(\frac{-A_M}{T_M(1)}\right)\left\{1 - V_R(1)\exp\left(\frac{-A_R}{T_R(1)}\right) k_p k_r\right\}}{V_M(2)\exp\left(\frac{-A_M}{T_M(2)}\right)\left\{1 - V_R(2)\exp\left(\frac{-A_R}{T_R(2)}\right) k_p k_r\right\}} = \frac{F_{NOx}(1)}{F_{NOx}(2)}$$

$$\therefore F_{NOx}(2)V_M(1)\exp\left(\frac{-A_M}{T_M(1)}\right) V_R(1)\exp\left(\frac{-A_R}{T_R(1)}\right) - F_{NOx}(1)V_M(2)\exp\left(\frac{-A_M}{T_M(2)}\right) \cdot V_R(2)\exp\left(\frac{-A_R}{T_R(2)}\right) k_p k_r = -F_{NOx}(2)V_M(1)\exp\left(\frac{-A_M}{T_M(1)}\right) + F_{NOx}(1)V_M(2)\exp\left(\frac{-A_M}{T_M(2)}\right) \tag{49}$$

$$\therefore k_p k_r = \frac{F_{NOx}(1)V_M(2)\exp\left(\frac{-A_M}{T_M(2)}\right) - F_{NOx}(2)V_M(1)\exp\left(\frac{-A_M}{T_M(1)}\right)}{F_{NOx}(2)V_M(1)\exp\left(\frac{-A_M}{T_M(1)}\right) V_R(1)\exp\left(\frac{-A_R}{T_R(1)}\right) - F_{NOx}(1)V_M(2)\exp\left(\frac{-A_M}{T_M(2)}\right) V_R(2)\exp\left(\frac{-A_R}{T_R(2)}\right)}$$

Moreover, $k_g p_n$ can also be obtained by substituting $k_p k_r$ into the equation (47) or (48).

Further, since $k_{VM}$, $k_{VR}$ shown in equations (39), (40) are also affected by the change in environmental conditions, it is desirable to compensate them every time.

It is easy to obtain $k_{VM}$, $k_{VR}$ through the actual measurements $V_M(1)$, $F_{fM}(1)$, $V_R(1)$, $F_{fR}(1)$ as follows:

$$k_{VM} = V_M(1)/F_{fM}(1) \tag{50}$$

$$k_{VR} = V_R(1)/F_{fR}(1) \tag{51}$$

Figure 12:
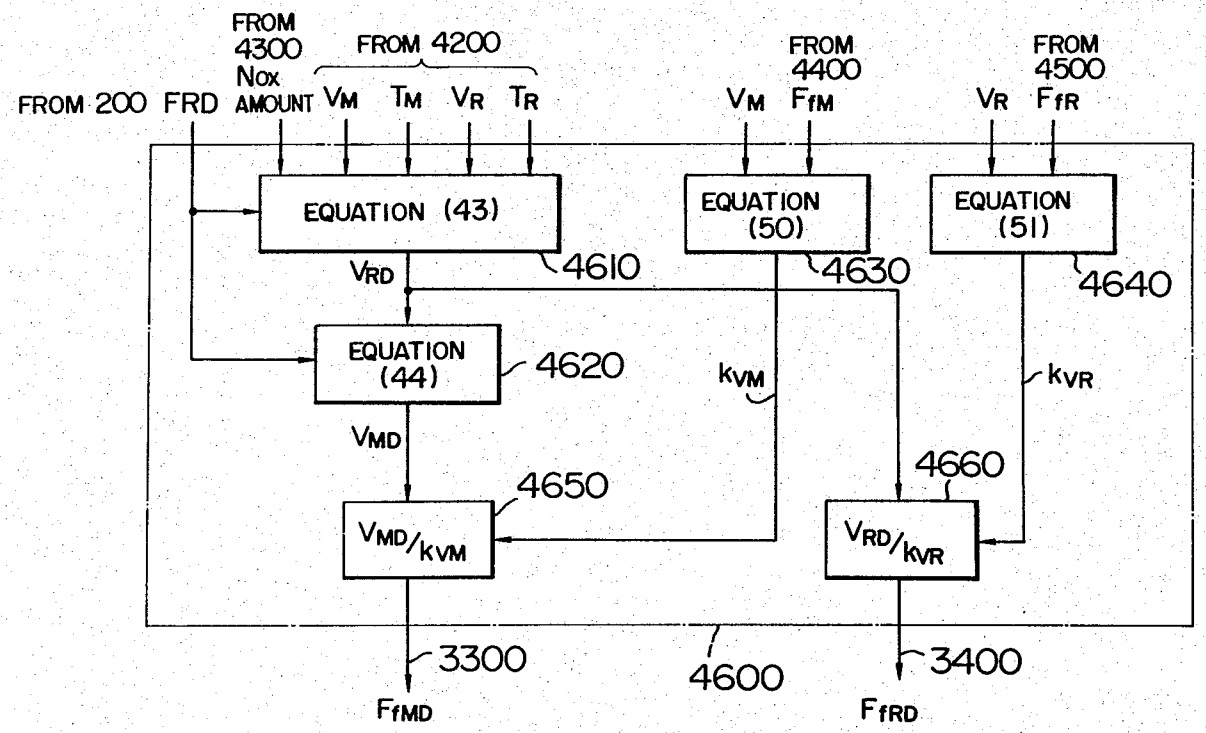
FIG. 12 is a block diagram for determination of fuel demands (of burners for a main combustion and a reducing combustion) in accordance with an embodiment of the invention.

FIG. 12 shows the conception of the abovedescribed functions. In the Figure, the calculation procedures are as follows:

(1) First, in the functions 4630, 4640, $k_{VM}$, $k_{VR}$ are obtained through the equations (50), (51).

(2) In the function 4610, $V_{RD}$ is obtained through the equation (43).

(3) In the function 4620, $V_{MD}$ is obtained through the equation (44).

(4) In the functions 46560 and 4660, $F_{fMD}$(3300), $F_{fRD}$(3400) are obtained through the equations (45), (46) and delivered.

Figure 13:
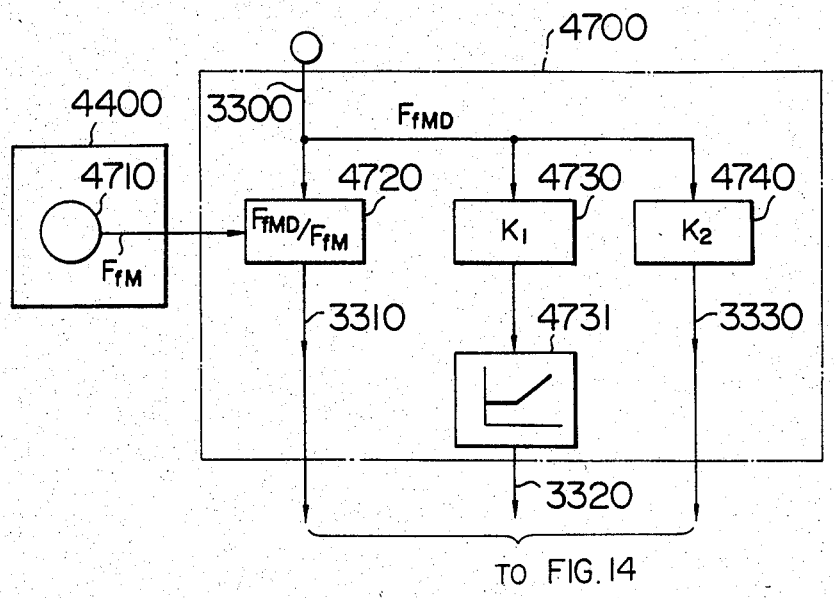
FIG. 13 is an illustration for describing a feeder driving motor speed demand signal and a primary or secondary air flow rate damper demand signal employed for controlling an flow rate of fuel in accordance with the embodiment of the invention.

Next, the method of controlling the main combustion zone and the reducing combustion zone will be explained. The fuel flow rate demand of each of them has been determined by the function 4600; therefore, the coal feeder speed demands 3310, 3410, the primary air flow rate demands 3320, 3420, the secondary air flow rate demands 3330, 3430 of the main and reducing combustion zones are determined in the functions 4700, 4800, respectively. The controlling method will be described hereinunder through the function 4700 as a representative of the two functions. FIG. 13 shows the principle of the controlling method. In the Figure, a reference numeral 3300 denotes the main combustion burner fuel flow rate demand $F_{fMD}$. The fuel flow rate demand $F_{fMD}$ is divided (function 4720) by the coal flow rate $F_{fM}$ estimated in the pulverized coal flow rate estimating means 4400, thereby to determine the coal feeder speed demand 3310. Further, since the object of the primary air is to carry the coal, the primary air flow rate demand 3320 can be obtained by multiplying (function 4730) the fuel flow rate demand $F_{fMD}$ by a proportionality factor $K_1$. However, as the primary air flow rate decreases, the carrying power extremely lowers. It is, therefore, a general practice to provide a limiting value (function 4731) so that the primary air flow rate will not be under a certain specified value even if $F_{fMD}$ becomes small. Finally, the secondary air flow rate demand 3330 is fundalentally obtained by multiplying (function 4740) the fuel flow rate demand $F_{fMD}$ by a proportionality factor $K_2$ as illustrated. In the case of coal, however, there are large changes in properties thereof. Therefore, it is now always optimal that the proportionality factors $K_1$, $K_2$ are constant for coal of any properties, and it is rather preferable to properly correct $K_1$, $K_2$ according to the properties of the employed coal. The same is the case with the function 4800.

Figure 14:
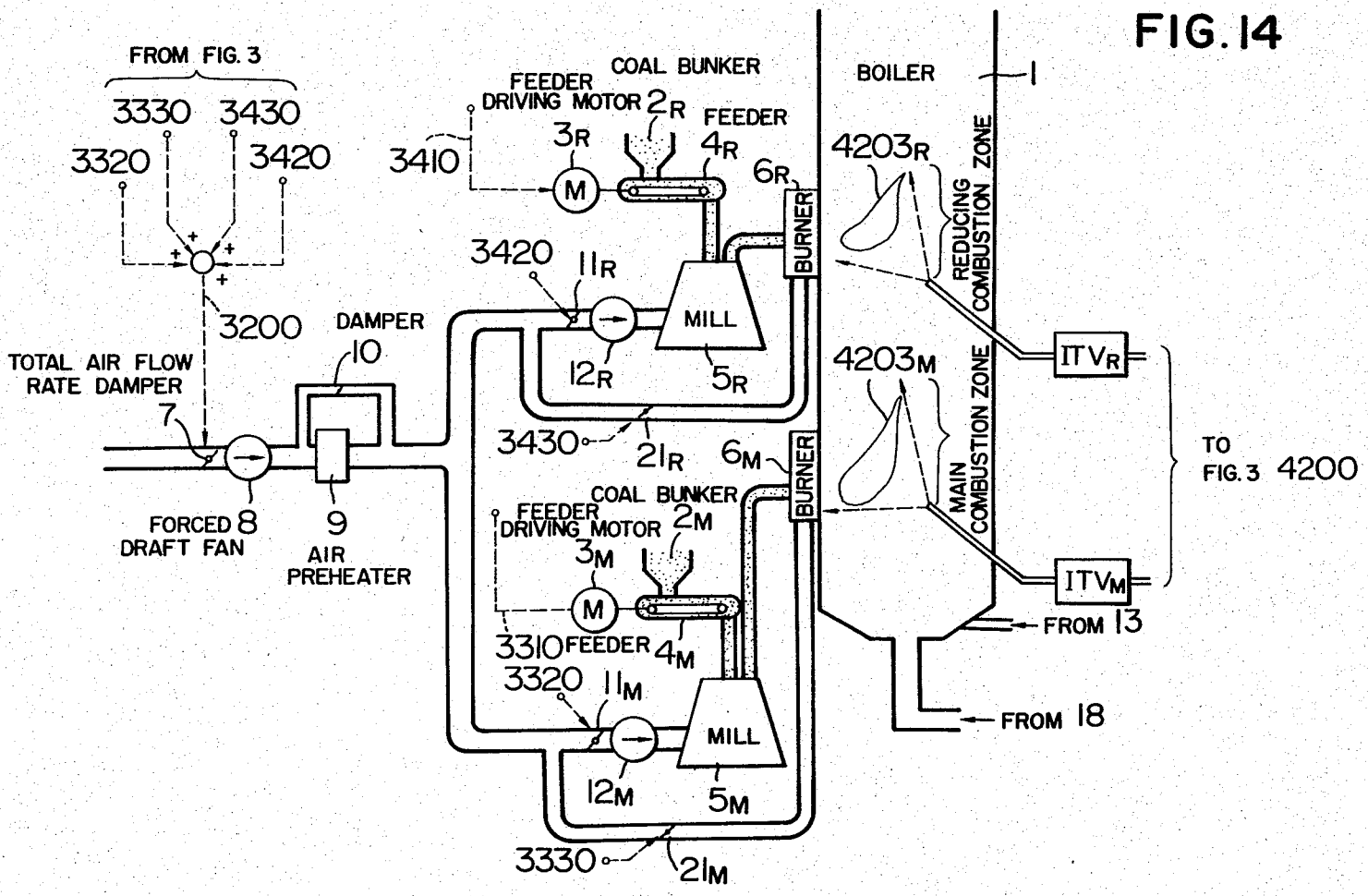
FIG. 14 is an illustration for describing the flow of the control signals in the case where the denitrification in a furnace having a burner for a main combustion and a burner for a reducing combustion is controlled by the output signals shown in FIG. 3.

FIG. 14 shows the relationship between the control signals in the case where the invention is applied to an actual furnace denitrification combustion control by means of the output signals from the fuel distributing means shown in FIG. 3. The parts or members similar to those in FIG. 1 are denoted by the same reference numerals. The parts or members related to the main combustion are suffixed with M, while the parts or members related to the reducing combustion are suffixed with R. The feeder driving motor speed demand signal and the primary and secondary air flow rate demand signals are controlled by the use of the fuel flow rate control system and the air flow rate control system as shown in FIG. 2, respectively, although not shown in FIG. 14. In other words, FIG. 14 only shows the flow of the control signals to illustrate which signal in FIG. 3 controls which part in FIG. 14. Thus, the flow rates of fuel and air supplied to burners $6_M$, $6_R$ are controlled and $NO_x$ generated in the main combustion zone is reduced in the reducing combustion zone, thereby to effect control so that the amount of $NO_x$ emission is below the specified value.

Although the invention has been described through specified terms, it is to be noted here that the described embodiment is not exclusive and various changes and modifications may be imparted thereto without departing from the scope of the invention which is limited solely by the appended claims.

What is claimed is:

1. A method of controlling combustion in a furnace in which a main combustion takes place followed by a reducing combustion and which has a burner for the reducing combination disposed in the stage subsequent to a burner for the main combustion in order to effect combustion for such a furnace denitrification that nitrogen oxides (NOx) generated in the main combustion zone by said main combustion burner are reduced by a reducing agent generated in the reducing combustion zone by said reducing combustion burner, said method comprising the steps of:

observing combustion flames formed by said main combustion burner and by said reducing combustion burner with image guide means operatively associated with said burners;

estimating the reducing agent generation amount on the basis of at least data on a pattern of a combustion flame formed by said reducing combustion burner among the data obtained from the observation of the combustion flame formed by said reducing combustion burner;

estimating the $NO_x$ generation amount on the basis of at least data on a pattern of a combustion flame formed by said main combustion burner among the data obtained from the observation of the combustion flame formed by said main combustion burner; and controlling the amount of fuel supplied to at least one of said main combustion burner and said reducing combustion burner so that said estimated reducing agent generation amount and $NO_x$ generation amount will be coincident with respective predetermined target values thereof to thereby control the amount of $NO_x$ emission from said furnace below a predetermined value.

2. A method of controlling combustion according to claim 1, wherein an estimated value of the volume of said flame is employed as said data on the flame pattern.

3. A method of controlling combustion according to claim 2, wherein said flame volume is operationally estimated as the product of the length of said flame and the flame width squared.

4. A method of controlling combustion according to claim 2, wherein said flame volume is operationally estimated from the projected area of said flame.

5. A method of controlling combustion according to claim 4, wherein said flame projected area is operationally estimated as the product of the length and width of said flame.

6. A method of controlling combustion according to claim 2, wherein a new flame volume in the case where there are variations in amount of fuel supplied is operationally estimated as a value proportional to the 3/2 power of the change ratio of the projected area of said flame.

7. A method of controlling combustion according to claim 6, wherein said new flame volume is operationally estimated as a value proportional to the cube of the change ratio of the projected width of said flame.

8. A method of controlling combustion according to claim 1, wherein the $NO_x$ generation amount is operationally estimated on the basis of the distance ($d_M$) between the outlet of said main combustion burner and the root of the flame formed by said main combustion.

9. A method of controlling combustion according to claim 1, wherein the $NO_x$ generation amount ($F_{gNOx}$) is estimated from the volume ($V_M$) of the flame formed by said main combustion, the distance ($d_M$) between the outlet of said main combustion burner and the root of the flame formed by said main combustion, the temperature ($T_g$) of the combustion gas in said main combustion zone, and the nitrogen partial pressure [$P_N$] in said main combustion zone, through the following equation:

$$F_{gNOx} = k_g \cdot V_M \cdot d_M \exp\left(\frac{-A_M}{T_M}\right) [P_N]$$

where, kg: a rate constant of generation of $NO_x$ $A_M$: a constant.

10. A method of controlling combustion according to claim 1, wherein said reducing agent generation amount is operationally estimated on the basis of the distance ($d_R$) between the outlet of sad reducing combustion burner and the root of the flame formed by said reducing combustion.

11. A method of controlling combustion according to claim 1, wherein said reducing agent generation amount ($F_{rNOx}$) is estimated on the basis of the volume ($V_R$) of the flame formed by said reducing combustion, the distance ($d_R$) between the outlet of said reducing combustion burner and the root of the flame formed by said reducing combustion, the temperature ($T_R$) of the reducing combustion gas, and the $NO_x$ partial pressure [$P_{NOx}$] in said reducing combustion zone, through the following equation:

$$F_{rNOx} = k_r \cdot V_R \cdot d_R \exp\left(\frac{-A_R}{T_R}\right) [P_{NOx}]$$

where, $k_r$: a rate constant of reduction $A_R$: a constant.

12. A method of controlling combustion according to claim 11, wherein said reducing agent generation amount ($F_{rNOx}$) is operationally estimated as a value proportional to said $NO_x$ generation amount ($F_{gNOx}$).

13. A method of controlling combustion according to claim 1, wherein said flame pattern is obtained as a region in a measured flame picture image which has a luminance or temperature above a predetermined level.

14. A method of controlling combustion according to claim 1, wherein the flow rate of pulverized coal as the flow rate of fuel supplied to each of said burners is estimated by the use of the Kalman filtering.

15. A method of controlling combustion according to claim 1, wherein said image guide means include optical fiber means positioned closely adjacent to the combustion flames formed by said main combustion burner and said reducing combustion burner and said method further comprising guiding combustion flame data outside of each of said combustion zones with said optical fiber means to an image pickup camera.

* * * * *